United States Patent [19]

Schick

[11] Patent Number: 4,473,787

[45] Date of Patent: Sep. 25, 1984

[54] EQUIPMENT FOR MAINTAINING THE SPACING OF TRACK-BOUND VEHICLES

[75] Inventor: Jean-Claude Schick, Aegerten, Switzerland

[73] Assignee: Inventio AG, Hergiswil, Switzerland

[21] Appl. No.: 395,033

[22] PCT Filed: Oct. 16, 1981

[86] PCT No.: PCT/CH81/00114

§ 371 Date: Jun. 14, 1982

§ 102(e) Date: Jun. 14, 1982

[30] Foreign Application Priority Data

Nov. 14, 1980 [CH] Switzerland ..... 8458/80

[51] Int. Cl.[3] ..... G05D 1/02; G01C 3/08; G08G 1/00

[52] U.S. Cl. ..... 318/587; 318/480; 340/903; 343/7 VC; 367/909

[58] Field of Search ..... 367/909; 340/33, 34; 318/480, 587, 70; 356/4, 28; 343/7 VC

[56] References Cited

U.S. PATENT DOCUMENTS

| | | | |
|---|---|---|---|
| 1,747,041 | 10/1928 | Alexanderson | 367/909 |
| 3,370,166 | 2/1968 | Rold et al. | 367/909 |
| 3,790,780 | 2/1974 | Helmcke et al. | 340/33 |
| 3,892,483 | 7/1975 | Saufferer | 367/909 |
| 4,026,654 | 5/1977 | Beaurain | 367/909 |
| 4,028,662 | 6/1977 | Young | 367/909 |

*Primary Examiner*—J. V. Truhe
*Assistant Examiner*—Bentsu Ro
*Attorney, Agent, or Firm*—Werner W. Kleeman

[57] ABSTRACT

The equipment for maintaining the spacing of track-bound vehicles (1) shall prevent collisions of the vehicles (1). For this, light emitters radiating rearwardly and laterally in desired directions are provided at the rear on the vehicles (1) and light receivers receiving from in front and from the sides in desired directions are provided at the front on the vehicles (1). A drive control reduces the speed of a vehicle (1) with increasing received light intensity, i.e. with decreasing spacing from the vehicle (1) travelling immediately ahead. The equipment is usable for floor conveying plants with vehicles (1) travelling at small spacings one behind the other. An embodiment of the equipment is suitable for vehicles (1) travelling forwardly and rearwardly. A further embodiment of the equipment is suitable for vehicles (1) on neighboring travel paths. Special measures are provided for compensation of the influences of ambient light.

4 Claims, 6 Drawing Figures

EQUIPMENT FOR MAINTAINING THE SPACING OF TRACK-BOUND VEHICLES

Figure 1:
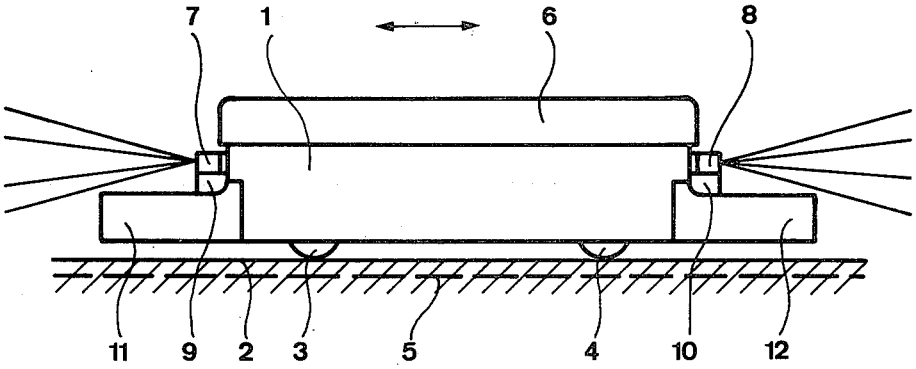

The invention concerns an equipment for maintaining the spacing of track-bound vehicles with light emitters radiating rearwardly against the direction of travel and with light receivers receiving from in front in direction of travel, which equipment by means of a drive control reduces the speed of a vehicle with decreasing spacing from the vehicle travelling directly ahead, wherein the spacing is determined on the basis of the received light signals.

An equipment of that kind for vehicles steerable automatically by means of a guide cable is known from the DE-OS No. 26 46 587. The guide cable is installed in the travel path and is supplied with a control pulse at regular time spacings for maintaining the spacing of the vehicle. The control pulse propagates along the guide cable and on reaching a vehicle effects the emission of a light pulse against the direction of travel. The control pulse and the light pulse originating from the preceding vehicle is detected on the following vehicle and the spacing is determined on the basis of the time between the pulses.

The equipment requires expensive locally fixed installations for maintaining the spacing. The locally fixed installations consist of the guide cable installed in the travel path and of the associated driving devices. The driving devices must be provided in such a manner that the control pulse propagates in a like sense of direction with respect to the direction of travel of the vehicles on each travel path portion, because the running times of the pulses in the guide cable and in the air are to be added or to be subtracted in accordance with the sense of direction. The parts of the equipment arranged on the vehicles are expensive, because the times to be evaluated between the pulses are very short in consequence of the very high speeds of propagation. The equipment does not evaluate reliably the short times between the pulses in case the pulses are distorted or in case the times are very short, wherein the distortions of the pulses increase with increasing length of travel path or guide cable and wherein the times between the pulses decrease with decreasing spacing.

The invention is based on the task of proposing a relatively simple equipment for maintaining the spacing of track-bound vehicles, which operates reliably on travel paths as long as desired, can be operated without locally fixed installations and the reliability of which increases with decreasing spacing.

The problem is solved according to the invention thereby, that a light emitter, operating with modulated light and radiating uniformly rearwardly and laterally in desired directions, is arranged at the rear on the vehicles, that a light receiver, demodulating light received from ahead and from the sides in desired directions, is arranged at the front on the vehicles and that the drive control reduces the speed of the vehicle with increasing received light intensity.

An example of embodiment of the invention, which is more closely explained in the following, is illustrated on the accompanying drawing.

Figure 2:
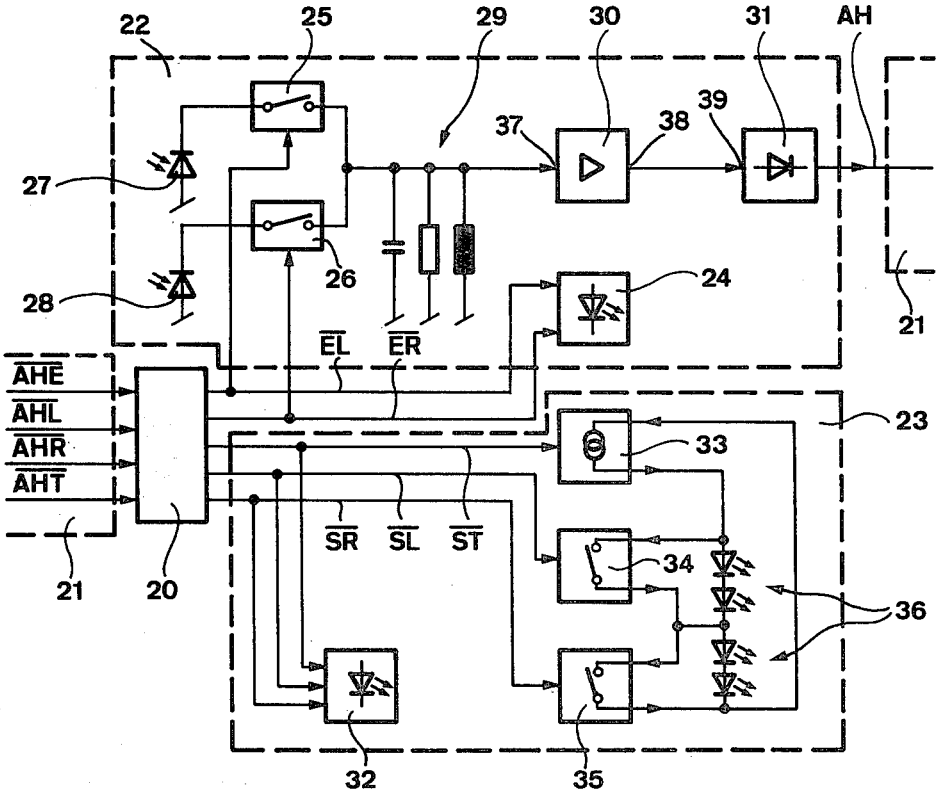
Figure 3:
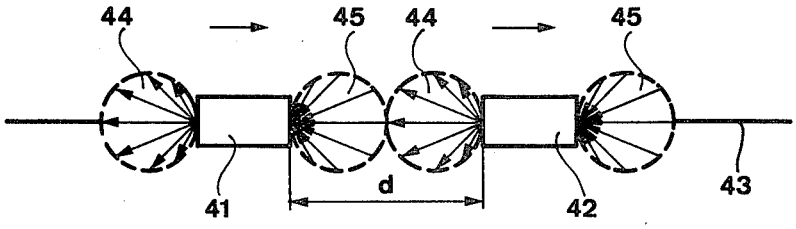
Figure 4:
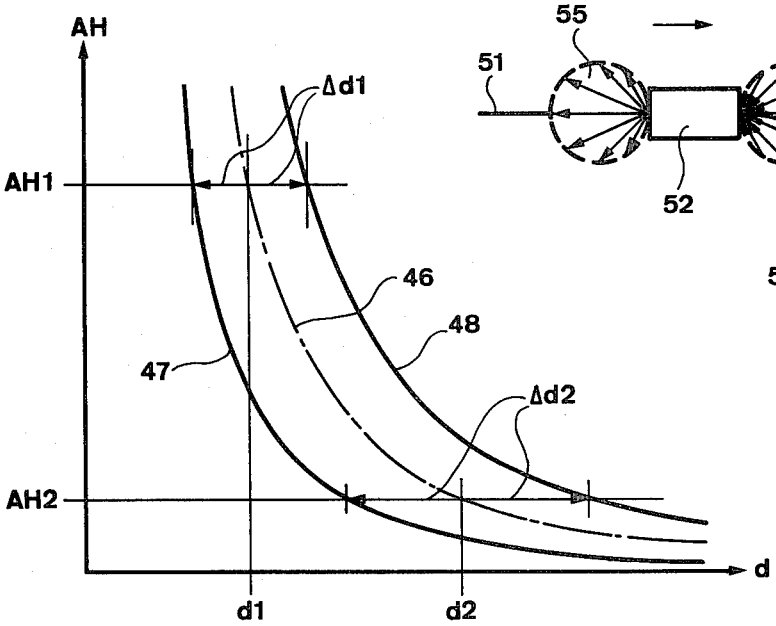
Figure 5:
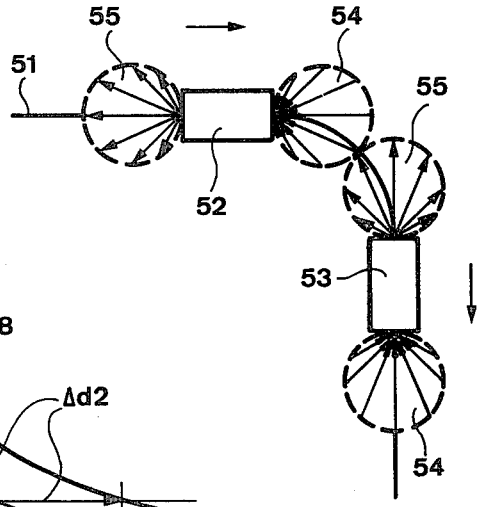
Figure 6:
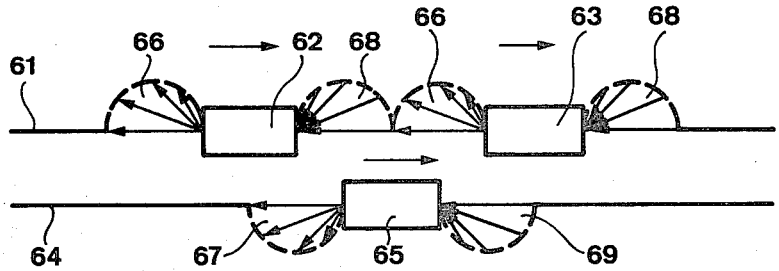

There show:

FIG. 1 in side elevation, a vehicle movable forwardly and rearwardly and with light emitters and light receivers provided at both sides, FIG. 2 a block schematic diagram of a light emitter arranged at the end of the vehicle and a light receiver arranged at the same end of the vehicle, FIG. 3 in plan view, a schematic illustration of two vehicles on straight path, FIG. 4 an illustration of the dependence of a signal AH on a spacing d, FIG. 5 in plan view, a schematic illustration of two vehicles on a curved path and FIG. 6 in plan view, a schematic illustration of three vehicles on neighbouring straight paths.

A battery-operated vehicle, which can move forwardly and rearwardly on a travel path 2 by means of wheels 3 and 4, of a floor conveyor plant is designated by 1 in the FIG. 1. A guide cable 5, which co-operates with not more closely illustrated steering equipments of the vehicle 1, can be disposed in the support of the travel path 2 for the automatic steering of the vehicle 1. Disposed at the upper side of the vehicle 1 are load receiving means 6, which can be constructed differently in correspondence with the kind of the loads to be conveyed. Light emitters and light receivers for both directions of travel are arranged in dust-proof glasshousings 7 and 8 at the front and at the rear on the vehicle 1. Provided directly under the glass housings 7 and 8 are metal housings 9 and 10, which contain the electrical devices of the light emitters and of the light receivers described more closely by reference to the block schematic diagram of FIG. 2. Disposed below the metal housings 9 and 10 are safety contacts which are embedded in rubber beads 11 and 12 and switch off the drive of the vehicle 1 in the case of collisions.

Designated by 20 in the FIG. 2 is a control circuit, at which four information signals $\overline{AHE}$, $\overline{AHL}$, $\overline{AHR}$ and $\overline{AHT}$ originating from a not more closely explained drive control, designated by 21, of the vehicle 1 are present and which generates five output signals $\overline{EL}$, $\overline{ER}$, $\overline{SL}$, $\overline{SR}$ and $\overline{ST}$. The output signals $\overline{EL}$ and $\overline{ER}$ are fed to a light receiver designated by 22, while the output signals $\overline{SL}$, $\overline{SR}$ and $\overline{ST}$ are fed to a light emitter designated by 23, wherein the light receiver 22 and the light emitter 23 are arranged on the same end of the vehicle.

The output signals $\overline{EL}$ and $\overline{ER}$ are present in the light receiver 22 on the one hand both at a first indicating device 24 indicating optically the mode of operation of the light receiver 22 and on the other hand individually at the control inputs of a first and a second electronic switching device 25 and 26, wherein two diodes 27 and 28 sensitive to infra-red light are connectible in parallel with a capacitor of a resonant circuit 29 by means of the contacts of the first and the second switching device 25 and 26. The two light-sensitive diodes 27 and 28 are arranged in a horizontal plane at the same angle relative to the direction of travel in such a manner that the light receiver 22 receives light in desired directions from the sides and from in front. The resonant circuit 29, which consists of a parallel connection of a capacitor, a coil and a resistor, is connected to the input 37 of an amplifier 30. The output 38 of the amplifier 30 is connected with the input 39 of a demodulator 31. The output signal, designated by AH, of the demodulator 31 is proportional to the received light intensity and is conducted to the drive control 21 for influencing the speed of travel of the vehicle 1.

The output signals $\overline{SL}$, $\overline{SR}$ and $\overline{ST}$ of the control circuit 20 are conducted in the light emitter 23 on the one hand to a second indicating device 32 optically indicating the mode of operation of the light emitter 23. On the other hand, the signal $\overline{ST}$ is present at the control input of a controllable current source 33, the signal $\overline{SL}$ at the control input of a third electronic switching device 34 and the signal $\overline{SR}$ at the control input of a fourth electronic switching device 35. The controllable current source 33 feeds a series connection 36 of twelve infrared luminescent diodes, wherein only four of the twelve luminescent diodes are illustrated. The luminescent diodes are arranged in fan shape in a horizontal plane in such a manner that the light emitter 23 radiates light uniformly in desired directions laterally and rearwardly. The contact of the third switching device 34 is connected in parallel with the six luminescent diodes, radiating towards the left, of the series connection 36, while the contact of the fourth switching device 35 is connected in parallel with the six luminescent diodes, radiating towards the right, of the series connection 36.

The digital signals or information signals mentioned in the preceding description can in usual manner assume two values designated by "0" and "1". There signify:

- $\overline{AHE}$ an information signal, which is produced by the drive control 21 and which during forward travel assumes the value $\overline{AHE}=0$ and during rearward travel the value $\overline{AHE}=1$,
- $\overline{AHL}$ an information signal, which is produced by the drive control 21 and which on the presence of a neighbouring travel path to the left of the vehicle 1 assumes the value $\overline{AHL}=1$ and otherwise the value $\overline{AHL}=0$,
- $\overline{AHR}$ an information signal, which is produced by the drive control 21 and which on the presence of a neighbouring travel path to the right of the vehicle 1 assumes the value $\overline{AHR}=1$ and otherwise the value $\overline{AHR}=0$,
- $\overline{AHT}$ a periodically changing timing information signal produced by the drive control 21 by means of a quartz-controlled generator,
- $\overline{EL}$ an output signal, which at $\overline{EL}=0$ switches on the left part angle of a light receiver 22, of the control circuit 20,
- $\overline{ER}$ an output signal, which at $\overline{ER}=0$ switches on the right part angle of a light receiver 22, of the control circuit 20,
- $\overline{SL}$ an output signal, which at $\overline{SL}=0$ frees the left part angle of a light emitter 23, of the control circuit 20,
- $\overline{SR}$ an output signal, which at $\overline{SR}=0$ frees the right part angle of a light emitter 23, of the control circuit 20 and
- $\overline{ST}$ an output signal, which at $\overline{ST}=0$ switches on a light emitter 23, of the control circuit 20.

The equipment described above operates as following:

As illustrated in the FIG. 3, it is assumed that two vehicles designated by 41 and 42 travel forwardly one behind the other on a straight path 43 according to the arrow directions and that no neighbouring travel paths are present. Consequently, the information signals $\overline{AHE}$, $\overline{AHL}$ and $\overline{AHR}$ display the values $\overline{AHE}=\overline{AHL}=ovs/AHR/=0$.

Under these conditions, the output signals $\overline{EL}$, $\overline{ER}$, $\overline{SL}$ and $\overline{SR}$ of the control circuits 20 disposed at the rear on the vehicles 41 and 42 have the values $\overline{EL}=\overline{ER}=1$ and $\overline{SL}=\overline{SR}=0$. By the values $\overline{EL}=\overline{ER}=1$, the light sensitive diodes 27 and 28 are separated from the resonant circuits 29 by means of the first and the second switching devices 25 and 26, whereby both part angles of the light receivers 22 arranged at the rear are switched off. By the values $\overline{SL}=\overline{SR}=0$, the luminescent diodes of the series connections 36 are not short-circuited by means of the third and fourth switching devices 34 and 35, whereby both part angles of the light emitters 23 arranged at the rear are freed. The signals $\overline{ST}$ like the information signals $\overline{AHT}$ change at a frequency of about 20 kiloHertz from "0" to "1" and conversely, for which reason the controllable current sources 33 feed the luminescent diodes of the series connections 36 with a current changing at the same frequency. The light emitters 23 radiate modulated infra-red light according to schematically illustrated emission characteristics 44, wherein the intensity of the light is proportional to the reciprocal of the square of the spacing.

With the information signal values $\overline{AHE}=\overline{AHL}=OVS/AHR/=0$ mentioned above, the output signals $\overline{EL}$, $\overline{ER}$, $\overline{SL}$ and $\overline{SR}$ of the control circuits 20 disposed at the front on the vehicles 41 and 42 have the values $\overline{EL}=\overline{ER}=0$ and $\overline{SL}=\overline{SR}=1$. By the values $\overline{SL}=\overline{SR}=1$, the luminescent diodes of the series connections 36 are short-circuited by means of the third and fourth switching devices 34 and 35, whereby both part angles of the light emitters 23 arranged at the front are switched off. By the values $\overline{EL}=\overline{ER}=0$, the light sensitive diodes 27 and 28 are connected in parallel with the capacitors of the resonant circuits 29 by means of the first and second switching devices 25 and 26, whereby both part angles of the light receivers 22 arranged at the front are switched on as illustrated schematically by means of receiving characteristics 45. Voltages, which consist of unidirectional components and alternating voltage components, are present at the light sensitive diodes 27 and 28. The resonant circuits 29, which are detuned to a certain degree with respect to the modulation frequency, conduct the alternating voltage components changing with the modulation frequency as received signals to the amplifiers 30 with a signal damping given by the detuning. With increasing intensities of ambient light, the alternating voltage components decrease in consequence of reduced sensitivities of the diodes 27 and 28. At the same time, the unidirectional voltage components decrease at the diodes 27 and 28, while the barrier layer capacitances of the diodes 27 and 28 increase. The increasing barrier layer capacitances of the diodes 27 and 28 have the effect that the detuning of the resonant circuits 29 decreases, whereby the resonant circuits 29 are compensated by means of decreasing signal damping through the decreasing sensitivities of the diodes 27 and 28. The received signals are amplified by the amplifiers 30 and demodulated by the demodulators 31. The signals AH appearing at the outputs of the demodulators 31 are dependent on the spacings d.

By reason of a given value, for example AH1 or AH2, of the signal AH, the drive control 21 of a vehicle 41 and 42 determines a spacing value d1 or d2 according to the course of the curve 46 illustrated in chain-dotted lines in the FIG. 4. In consequence of different pollution of the glass housings 7 and 8, the determined value d1 or d2 can deviate from the spacing d present, wherein the limits of the possible range of deviation $\Delta d1$ or $\Delta d2$ are illustrated by curves 47 and 48. It is evident from the curves 46, 47 and 48 that the region $\Delta d1$ and $\Delta d2$ becomes narrower with decreasing spacing value d1 and d2, because the curves 46, 47 and 48 extend more steeply with decreasing spacing d. Consequently, the relibility of the equipment increases with decreasing spacing d. The determined spacing value d1 or d2 serves the drive control 21 for the control of the speed of travel.

Two vehicles travelling forwardly one behind the other on a curved path 51 are designated by 52 and 53 in the FIG. 5. Since no neighbouring travel paths are present, the information signals and the signals have the same values as for the vehicles 41 and 42 of the FIG. 3. The reception characteristics 54 and emission characteristics 55, which are unchanged compared with the FIG. 3, show that the equipment functions also on the curved path 51.

Two vehicles travelling forwardly one behind the other on a straight path 61 are designated by 62 and 63 in the FIG. 6. A neighbouring straight path 64, on which a vehicle 65 moves in the same direction, is present in travel direction to the right of the path 61. The information signals E,ovs/AHL/ and E,ovs/AHR/ of the vehicles 62 and 63 travelling on the lefthand path 61 display the values E,ovs/AHL/ =0 and E,ovs/AHR/ =1, while the information signals E,ovs/AHL/ and E,ovs/AHR/ of the vehicle 65 travelling on the righthand path 64 display the values E,ovs/AHL/ =1 and E,ovs/AHR/ =0. Under these conditions, the output signals E,ovs/ER/ and E,ovs/SR/ of the control circuits 20 of the vehicles 62 and 63 travelling on the left assume the values E,ovs/ER/ =E,ovs/SR/ =1 and the output signals E,ovs/EL/ and E,ovs/SL/ of the control circuits 20 of the vehicle 65 travelling on the right assume the values E,ovs/El/ =E,ovs/SL/ =1, whereby the part angles, which are directed towards the neighbouring path 61 and 64, of the light emitters 23 and light receivers 22 of the vehicles 62, 63 and 65 are switched off. All other information signals and signals have the same value as the information signals and signals of the vehicles 41 and 42 of the FIG. 3, for which reason the other part angles of the light emitters 23 and light receivers 22 are switched on according to the direction of travel. This is illustrated schematically by means of emission characteristics 66 and 67 and reception characteristics 68 and 69. Consequently, the light emitters 23 and light receivers 22 of the vehicles 62, 63 and 65 of neighbouring paths 61 and 64 do not influence one another.

For the practical execution of the equipment according to the invention, it is advantageous to provide like devices at the front and the rear on vehicles movable forwardly and rearwardly, wherein the informtion signals E,ovs/AHL/ and E,ovs/AHR/ are fed interchanged to the rear devices and wherein the information signal E,ovs/AHE/ is fed to the rear devices through a NOT-member which is provided in the devices and switchable in selectably.

It lies within the scope of the invention to provide analog-digital converters for the signals AH and to perform by digital means the determination of the spacing values d1 and d2 starting from a given signal value AH1 and AH2.

It furthermore lies within the scope of the invention to provide covers on the light emitters and on the light receivers in such a manner that only small vertical angular ranges remain free for the operation of the light receivers and light emitters.

It furthermore lies within the scope of the invention to arrange individually switchable light emitters of like kind to be locally fixed and therewith to regulate the traffic flow at crossings, load transfer stations or the like.

I claim:

1. Equipment for maintaining the spacing of track-bound vehicles having a front end and a rear end with respect to a vehicle travel direction, each vehicle being driven along a track by respective drive means in a selected one of two opposed directions of travel, said equipment comprising:

a light emitter mounted at each end of each one of said vehicles and operable to uniformly longitudinally and laterally emit light in predetermined directions;

said light emitter being operable to emit modulated light;

a light receiver mounted at each end of each one of said vehicles and operable to receive light emitted uniformly and laterally towards said light receiver;

said light receiver being operable to receive incoming modulated light and to generate demodulated output signals;

a first switching device acting on said light emitter;

a second switching device acting on said light receiver;

said first and said second switching devices of each vehicle cutting-off the light emitted to one side of said light emitter and the reception of said emitted light at a corresponding side of said light receiver, respectively;

a drive control for each said drive means of the vehicles;

said first and said second switching devices being operated upon by said drive control of said vehicle; and said drive control of said trailing vehicle being operable in response to the intensity of said light received by said light receiver on said trailing vehicle and emitted by said light emitter on said leading vehicle, so that the speed of said trailing vehicle is reduced as said intensity of said light received by said light receiver on said trailing vehicle increases.

2. Equipment for maintaining the spacing of track-bound vehicles having a front end and a rear end with respect to a vehicle travel direction, each vehicle being driven along a track by respective drive means in at least one of two opposed directions of travel, said equipment comprising:

a light emitter mounted at the rear end of a leading one of said vehicles with respect to the vehicle travel direction and operable to uniformly rearwardly and laterally emit light in predetermined directions;

said light emitter being operable to emit modulated light;

a light receiver mounted at the front end of a trailing one of said vehicles with respect to the vehicle travel direction and operable to receive light emitted uniformly and laterally towards said light receiver by the leading vehicle;

said light receiver being operable to receive incoming modulated light and to generate demodulated output signals;

a drive control for each said drive means of the vehicles; and said drive control of said trailing vehicle being operable in response to the intensity of said light received by said light receiver on said trailing vehicle and emitted by said light emitter on said leading vehicle, so that the speed of said trailing vehicle is reduced as said intensity of said light received by said light receiver on said trailing vehicle increases;

means for generating a periodic timing signal said light emitter further comprising:

a current source controllable by said periodic timing signal;

a number of infrared emitting diodes power suplied by said current source;

said infrared emitting diodes being arranged in a fan shape configuration substantially in a horizontal plane and being laterally and rearwardly directed at a predetermined emission angle; and said light receiver further comprising:

at least two infrared sensitive diodes;

said at least two infrared sensitive diodes being arranged substantially in said horizontal plane and being forwardly and laterally directed to cover an angle which is essentially the same as said predetermined emission angle;

an amplifier having an input and an output;

said input being connectable to each one of said infrared sensitive diodes in order to receive a superposed signal; and a demodulator having an input connected to said output of said amplifier and being connected to said drive control on its output side.

3. The equipment as defined in claim 2, wherein:

said light receiver comprises a first and a second switching device each interconnected between a respective one of said infrared sensitive diodes and said input of said amplifier;

each said first and second switching device being operable by said drive control;

said light emitter forming two groups of said infrared emitting diodes each associated with one side of said light emitter;

said light emitter further comprising a third and a fourth switching device each connected parallel to a respective one of said groups of said infrared emitting diodes; and said third and fourth switching devices being operable by said drive control.

4. The equipment as defined in claim 2, wherein:

said light receiver further comprises:

a resonant circuit comprising a capacitor and said resonant circuit being connected to said input of said amplifier; and said infrared sensitive diodes, changing their capacitance and their sensitivity with changing intensity of the ambient light, and being connected parallel to said capacitor.

* * * * *

UNITED STATES PATENT AND TRADEMARK OFFICE

CERTIFICATE OF CORRECTION

PATENT NO. : 4,473,787

DATED : September 25, 1984

INVENTOR(S) : Jean-Claude Schick

It is certified that error appears in the above—identified patent and that said Letters Patent is hereby corrected as shown below:

Column 3, line 59, "=ovs/AHR/=0", should read: --=$\overline{AHR}$=0--

Column 4, line 16, "=OVS/AHR/=0", should read: --=$\overline{AHR}$=0--

Column 4, line 32, after "unidirectional" insert --voltage--

Column 5, line 17, "E,ovs/AHL/ and E,ovs/AHR/", should read: --$\overline{AHL}$ and $\overline{AHR}$--

Column 5, line 19, "E,ovs/AHL/=0 and E,ovs/AHR/", should read: --$\overline{AHL}$=0 and $\overline{AHR}$--

Column 5, line 20, "E,ovs/AHL/", should read: --$\overline{AHL}$--

Column 5, line 21, "E,ovs/AHR/", should read: --$\overline{AHR}$--

Column 5, line 22, "E,ovs/AHL/=1", should read: --$\overline{AHL}$=1--

Column 5, line 23, "E,ovs/AHR/=0", should read: --$\overline{AHR}$=0--

Column 5, line 24, "E,ovs/ER/ and E,ovs/SR/", should read: --$\overline{ER}$ and $\overline{SR}$--

Column 5, line 26, "E,ovs/ER/=E,ovs/SR/=1", should read: --$\overline{ER}$=$\overline{SR}$=1--

Column 5, line 27, "E,ovs/EL/ and E,ovs/SL/", should read: --$\overline{EL}$ and $\overline{SL}$--

Column 5, line 29, "E,ovs/El/=E,ovs/SL/=1", should read: --$\overline{EL}$=$\overline{SL}$=1--

Column 5, line48, "E,ovs/AHL/ and E,ovs/AHR/", should read: --$\overline{AHL}$ and $\overline{AHR}$--

UNITED STATES PATENT AND TRADEMARK OFFICE

CERTIFICATE OF CORRECTION

PATENT NO. : 4,473,787

DATED : September 25, 1984

INVENTOR(S) : Jean-Claude Schick

It is certified that error appears in the above—identified patent and that said Letters Patent is hereby corrected as shown below:

Column 5, line 50, "E,ovs/AHE/", should read --$\overline{\text{AHE}}$--

Signed and Sealed this

*Twenty-sixth* Day of *March 1985*

[SEAL]

*Attest:*

DONALD J. QUIGG

*Attesting Officer* *Acting Commissioner of Patents and Trademarks*